US005144677A

United States Patent [19]

Asakura et al.

[11] Patent Number: 5,144,677

[45] Date of Patent: Sep. 1, 1992

[54] HAND-HELD MICROPHONE APPARATUS WITH RESILIENT STABILIZING RING

[75] Inventors: Michihito Asakura, Tendo; Satoshi Hasegawa, Tokyo, both of Japan

[73] Assignee: Pioneer Electronic Corporation, Tokyo, Japan

[21] Appl. No.: 607,393

[22] Filed: Oct. 31, 1990

[30] Foreign Application Priority Data

Mar. 19, 1990 [JP] Japan ..... 2-227240[U]

[51] Int. Cl.[5] ..... H04R 25/00

[52] U.S. Cl. ..... 381/169; 381/150; 381/168

[58] Field of Search ..... 381/91, 95, 150, 153, 381/155, 158, 168, 169, 170

[56] References Cited

U.S. PATENT DOCUMENTS

| | | | |
|---|---|---|---|
| 4,065,648 | 12/1977 | Cvetko et al. | 381/168 |
| 4,694,499 | 9/1987 | Bartlett | 381/155 |
| 4,937,877 | 6/1990 | Pocock et al. | 381/158 |
| 4,991,220 | 2/1991 | Wolf | 381/169 |
| 5,042,071 | 8/1991 | Stinauer et al. | 381/158 |
| 5,054,079 | 10/1991 | Frielingsdorf et al. | 381/151 |

FOREIGN PATENT DOCUMENTS

| | | | |
|---|---|---|---|
| 0062294 | 9/1984 | Japan | 381/153 |
| 0204398 | 11/1984 | Japan | 381/169 |

OTHER PUBLICATIONS

Audio-Technica, "Road Tough? Prove It", Sound and Communications, Aug. 1979, p. 57.

Audio-Technica, "10 Reasons Why You Can't Buy a Better Vocal Microphone", J. Audio Eng. Soc. vol. #32 #78.

Radio Shack, "1990 Catalog" (#446), copyright 1989 pp. 38 and 39.

Lafayette Radio Electronics, p. 156 Lafayette Catalog, #700, 1970.

*Primary Examiner*—James L. Dwyer
*Assistant Examiner*—William D. Cumming
*Attorney, Agent, or Firm*—Sughrue, Mion, Zinn Macpeak & Seas

[57] ABSTRACT

A microphone apparatus consists of a microphone body which incorporates a built-in microphone chip; a microphone cover formed of a net material and secured to the front end of the microphone body to enclose and protect the microphone chip inside; and a resilient ring whose outer circumference is shaped into a polygon. The resilient ring may be fitted directly over the net microphone cover; or it may be installed in a coupling ring that connects separated base and end portions of the microphone cover together. The polygonal outer surface of the resilient ring on the microphone cover prevents the microphone apparatus from rolling and fall when placed on a table because one of the flat sides of the polygon which is in contact with the table surface stabilizes the apparatus. Thanks to its resiliency, the polygonal resilient ring can be removed from the microphone cover so that any change that might occur when the ring blocks the sound wave can be prevented.

2 Claims, 1 Drawing Sheet

HAND-HELD MICROPHONE APPARATUS WITH RESILIENT STABILIZING RING

BACKGROUND OF THE INVENTION

The present invention relates to a microphone apparatus, held by hand or mounted on a stand, which incorporates a microphone or sound pressure-current converting means, and which converts sound wave that into an electrical current, amplifying the current for use in a speaker system.

PRIOR ART

Conventional microphone apparatuses used in applications such as a tape-recorded orchestral accompaniment device generally incorporate a microphone chip and consist of a microphone body that is held by hand or erected on a stand. A microphone cover formed of a net material and roughly shaped into a sphere to protect the microphone chip is typically built into the microphone body.

To allow the microphone body to be easily held by hand or inserted into the microphone stand, the microphone body has a circular cross section.

SUMMARY OF THE INVENTION

Since the microphone body has a circular cross section and the microphone cover is roughly spherical, the microphone rolls easily when placed on a flat surface, possibly resulting in damage.

It is therefore an object of this invention to provide a microphone apparatus which solves the problems mentioned above while maintaining the microphone's directivity.

This objective can be achieved by a microphone apparatus comprising a microphone body into which a microphone or a sound pressure-current converting means is attached; a microphone cover formed of a net material mounted to the body so as to cover and protect the built-in microphone; and a resilient ring attached over the microphone cover, the ring having an outer circumference in the form of a polygon.

PREFERRED EMBODIMENT OF THE INVENTION

Figure 1:
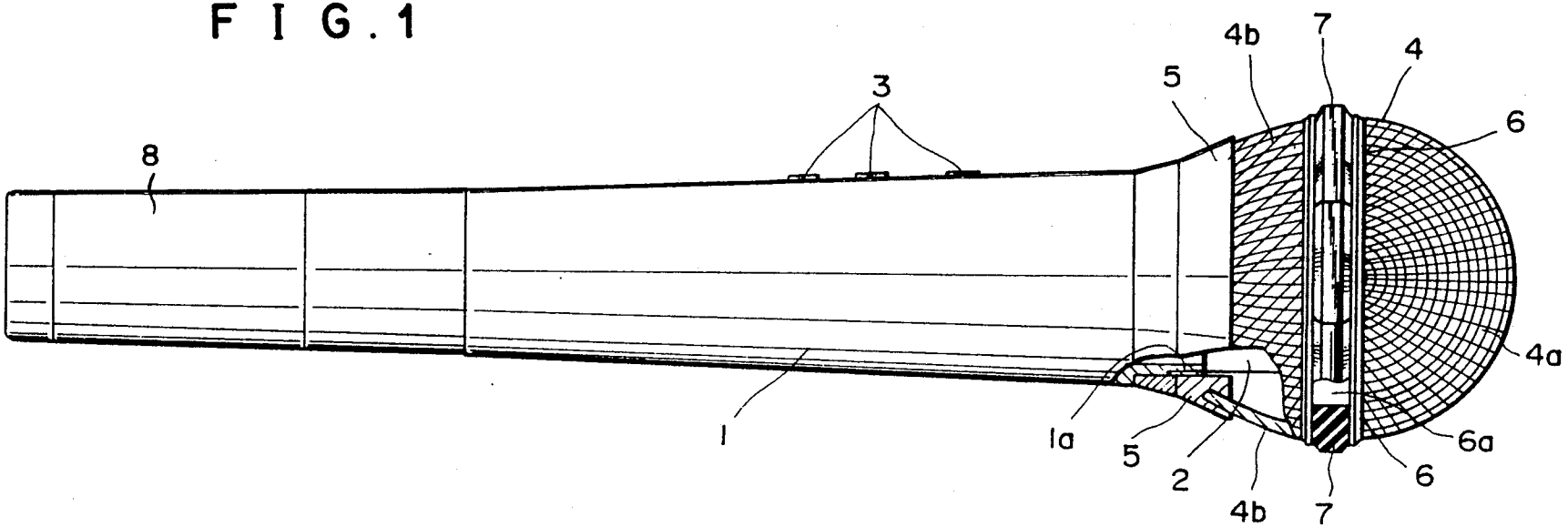
FIG. 1 is a partly cutaway side view of one embodiment of the invention.

One preferred embodiment of this invention will be described by referring to FIG. 1.

Reference numeral 1 refers to a microphone body with circular cross section which has attached a microphone chip 2 that converts sound pressure into an electrical current. The microphone body 1 also has attached a switch 3 at one side that controls a circuit of the microphone chip 2. The microphone body 1 is threaded with a male screw 1*a* on the outer periphery surrounding the microphone chip 2.

Denoted 4 is a microphone cover made up of an end cover 4*a* formed of a net material and shaped into a hemisphere, and a base cover 4*b* formed of a net material and shaped into a truncated hemisphere. The microphone cover 4 is fixed to the microphone body 1 by a female screw 5 which is secured by the truncated portion of the base cover 4*b* and male seven 1*a*.

The end cover 4*a* and the base cover 4*b* are coupled together by a coupling ring 6 which has a groove 6*a* formed along an outer circumference thereof. The microphone cover 4 encloses the microphone chip 2 for its protection.

Designated 7 is a resilient ring formed of polypropylene mixed with a rubber. The resilient ring 7 is sized such that its inner surface fits into the groove 6*a* of the coupling ring 6. The outer periphery of the resilient ring 7 is formed into a polygon.

When the microphone is put on a flat surface, the polygonal outer circumference of the resilient ring 7 comes into contact with the table surface, thus preventing the microphone from rolling.

In this embodiment, the coupling ring 6 is used to connect the end cover 4*a* and the base cover 4*b* together. When the microphone cover 4 is formed as a globe of a net material, however, the coupling ring 6 may be removably mounted on the microphone cover 4, and the resilient ring 7 attached to the coupling ring 6, as above.

Figure 2:
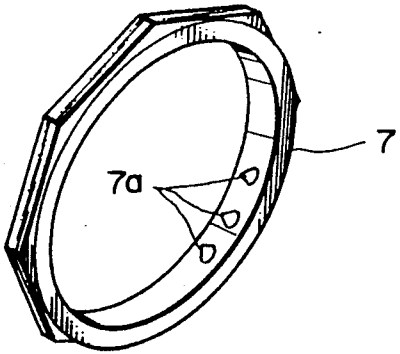
FIG. 2 is a perspective view of a resilient ring of another embodiment of the invention.

It is also possible to omit the coupling ring 6 and directly mount the resilient ring 7 on the microphone cover 4. In this embodiment, as shown in FIG. 2, the resilient ring 7 is preferably provided with projections 7*a* on the inner circumference that will fit into the meshes of the net of the microphone cover 4 so that the resilient ring 7 cannot easily be removed from the cover 4.

Furthermore, when the resilient ring 7 is removed, there is nothing around the net of the microphone cover 4 that can obstruct sound waves and interfere with the microphone's directivity.

Denoted 8 is a battery cover that is screwed into the rear end of the microphone body 1 and which is coated over its outer surface with a resilient material of polypropylene mixed with rubber.

The advantages of this invention may be summarized as follows.

Since the resilient ring, whose outer surface is shaped as a polygon, is fitted over the microphone cover, the microphone is prevented from rolling when it is placed on a flat surface.

The resilient ring can be easily removed from the microphone cover because of its resilience so as to prevent any changes in directivity resulting from the presence of the resilient ring.

Moreover, the resilient ring also acts to prevent deformation of the microphone cover in the event the microphone falls or is dropped. A further embodiment includes a resilient cap attached to the rear end of the microphone body which further acts to protect the precision electronic circuitry and reduce amplified impact noise in the event the microphone falls or is dropped.

What is claimed is:

1. A hand-held microphone apparatus comprising:

a microphone body (1) having a generally cylindrical housing;

a microphone chip (2), fixedly secured to a proximal or speaking end of said microphone body, said microphone chip functioning as a sound pressure-current converting means;

a microphone cover (4) formed from a net or screen material having a plurality of interstices, and defining a truncated sphere enclosing and protectively surrounding said microphone chip, said cover having a maximum diameter portion greater than a maximum diameter of said housing; and a resilient, easily removable, stabilizing ring (7) fitted over said microphone cover at said maximum diameter portion thereof and mounted normal to an axis of said microphone body, said resilient ring having an outer circumference in the shape of a regular polygon so as to prevent the microphone from rolling when placed on flat surfaces and including projections (*7a*) circumferentially spaced on an inner circumference thereof, said projections fitting into said interstices to securely and fixedly attach said ring to said cover.

2. A hand-held microphone apparatus comprising:

a microphone body (1) having a generally cylindrical housing;

a microphone chip (2), fixedly secured to a proximal or speaking end of said microphone body, said microphone chip functioning as a sound pressure-current converting means;

a microphone cover (4) formed from a net or screen material having a plurality of interstices, and defining a truncated sphere enclosing and protectively surrounding said microphone chip, said cover having a maximum diameter portion greater than a maximum diameter of said housing; and a resilient, easily removable, stabilizing ring (7) fitted over said microphone cover at said maximum diameter portion thereof and mounted normal to an axis of said microphone body, said resilient ring having an outer circumference in the shape of a regular polygon so as to prevent the microphone from rolling when placed on flat surfaces, said microphone cover being formed from a base cover (**4*b*) and an end cover (4*a*) coupled together by a coupling ring (6**), an outer circumference of said coupling ring defining a groove for accommodating said resilient ring.

* * * * *